US006156989A

United States Patent [19]

Miller et al.

[11] Patent Number: 6,156,989

[45] Date of Patent: Dec. 5, 2000

[54] MULTI-PHASE VACUUM SWITCH ARRANGEMENT INCLUDING AN ELECTROMAGNET ACTUATING MECHANISM

[75] Inventors: David D. Miller, Kitchener; Mark W. Eady, Dundas, both of Canada

[73] Assignee: Rockwell Technologies, LLC, Thousand Oaks, Calif.

[21] Appl. No.: 09/409,571

[22] Filed: Sep. 30, 1999

[51] Int. Cl.[7] ..... H01H 33/66; H01H 33/28

[52] U.S. Cl. ..... 218/120; 218/153

[58] Field of Search ..... 218/118, 119, 218/120, 140, 152, 153

[56] References Cited

U.S. PATENT DOCUMENTS

| | | | |
|---|---|---|---|
| 2,906,841 | 9/1959 | Jennings | 218/119 |
| 3,870,845 | 3/1975 | Clason | 218/119 |
| 4,306,129 | 12/1981 | Bialkowski et al. | 218/120 |
| 4,587,390 | 5/1986 | Gray | 218/84 X |

FOREIGN PATENT DOCUMENTS

| | | |
|---|---|---|
| 1262349 | 7/1959 | France . |
| 1901067 | 10/1969 | Germany . |

OTHER PUBLICATIONS

Slade, P. and Long, R., "Vacuum Technology for Medium Voltage Switching and Protection", Power Technologh International, 1993, pp. 171–175.

"How a New Vacuum Interrupter Was Developed", Research/Development Magazine, Sep. 1968.

Selzer, A., "Vacuum Interruption—A Review of the Vacuum Arc and Contact Functions" IEEE Transactions on Industry Applications, vol. IA–8, No. 6, Nov./Dec. 1972, pp. 707–722.

Rockwell Automation, User Manual for Medium Voltage Contactor, Publication No. 1502–5.0, May 1998.

*Primary Examiner*—J. R. Scott

*Attorney, Agent, or Firm*—Alex Porat; John J. Horn; William R. Walbrun

[57] ABSTRACT

A multi-phase vacuum contactor occupying a minimal space envelope. The contactor features a housing; a carriage; an electromagnetic actuator fixed to the housing and having a reciprocating armature connected to the carriage; and a plurality of vacuum interrupters each having a reciprocating stem for the actuation thereof, wherein the vacuum interrupters are fixed to the housing and circumferencially arranged about the electromagnetic actuating mechanism such that longitudinal axes of the vacuum interrupters are substantially parallel to a longitudinal axis of the electromagnetic actuating mechanism, and wherein the stem of each vacuum interrupter is connected to the carriage.

7 Claims, 4 Drawing Sheets

MULTI-PHASE VACUUM SWITCH ARRANGEMENT INCLUDING AN ELECTROMAGNET ACTUATING MECHANISM

FIELD OF INVENTION

The invention relates to the art and manufacture of vacuum contactors, and more particularly, multi-phase vacuum contactors comprised of a plurality of vacuum interrupters and an actuating mechanism for the control thereof.

BACKGROUND OF INVENTION

Vacuum contactors are utilized as switching or circuit-breaking mechanisms for a variety of alternating current (AC) loads such as three-phase motors, transformers, power distribution switchgear, surge suppression circuits, power capacitors and resistive heating loads. The vacuum contactor may be found in medium voltage power circuit applications ranging up to about 38 kV.

A vacuum contactor typically comprises a number of vacuum interrupters equal to the number of electrical phases and an actuating mechanism for the control thereof. The vacuum interrupter is a vacuum tight bottle in which a pair of contacts is enclosed. One of the contacts is fixed to one end of the bottle and the other contact is movable. The movable contact has a movable stem extending from the other end of the bottle and is sealed thereto by means of a bellows. The bellows allows the movable contact to reciprocate between a closed position wherein the movable contact abuts the fixed contact and an open position wherein the movable contact is spaced apart from the fixed contact at a distance sufficient to prevent arcing at a given breakdown voltage. If the contacts are separated while alternating current is flowing an arc will be formed which begins to vaporize the contact faces. This forms a charged vapour which is collected on a shield disposed within the bottle. However, as the alternating current reaches a zero magnitude the arc will extinguish and, because the rapid dispersion of the vapour leaves no charged medium in the vacuum, the arc will be unable to re-establish itself between the open contacts.

Since the vacuum interrupters encase their contacts within a vacuum, the normal, unbiased, position of a vacuum interrupter is the closed position. Some sort of biasing means, such as a spring-loaded solenoid as discussed in greater detail below, is typically employed to bias the vacuum interrupter in the open position, and to close the vacuum interrupters upon command.

An example of a typical three-phase vacuum contactor 10 is described with reference to FIGS. 1 and 2 which show front and cross sectional views thereof. As shown, the contactor 10 comprises three vacuum interrupters 12 arranged in a single row along the same plane and fixed to a casing 14. Each vacuum interrupter 12 has a moveable shaft or stem 22 for opening and closing the vacuum interrupter. These shafts are surrounded by electrical insulators 26. An electromagnetic actuating device 16 is disposed below the row of vacuum interrupters 12 and is orientated normal to the plane in which the vacuum interrupters lie. The actuator 16 features an armature 18 that is connected to an L-shaped mechanical linkage 20 which, in turn, is pivotably linked to the movable shafts or stems 22 of the vacuum interrupter. A spring 24 is attached to the casing 14 and provided to bias the mechanical linkage 20 and the vacuum interrupters 12 in the open position, as shown in FIG. 2 wherein the mechanical linkage 20 abuts against a stop 26. A second spring 28 is disposed about each moveable shaft or stem 22 between the mechanical linkage 20 and the elecrical insulator 26. To close the vacuum interrupters 12 the actuator 16 must be energized, causing the mechanical linkage 20 to compress springs 24 and 28 as well as the moveable shafts or stems 22 of the vacuum interrupters. It will thus been seen that the stroke of the electromagnetic actuating device 16 is orientated perpendicular to the strokes of the vacuum interrupters 12. This design, while durable and proven in the field, is overly bulky.

While prior art multiphase contactors such as the one described above have proved useful and durable in a wide range of applications, mechanically, they are rather bulky. The invention therefore seeks to provide vacuum contactors capable of occupying minimal space envelopes.

SUMMARY OF INVENTION

According to one aspect of the invention a multi-phase vacuum contactor occupying a minimal space envelope is provided. The contactor features a housing; a carriage; an electromagnetic actuator fixed to the housing and having a reciprocating armature connected to the carriage; and a plurality of vacuum interrupters each having a reciprocating stem for the actuation thereof, wherein the vacuum interrupters are fixed to the housing and circumferencially arranged about the electromagnetic actuating mechanism such that longitudinal axes of the vacuum interrupters are substantially parallel to a longitudinal axis of the electromagnetic actuating mechanism, and wherein the stem of each vacuum interrupter is connected to the carriage.

The contactor preferably includes a resilient member disposed between the electromagnetic actuator and the carriage for biasing the vacuum interrupters in an open position. The contactor preferably also includes a resilient member disposed between the actuator and the carriage, or the carriage and each vacuum interrupter, for enabling the stroke of the armature to be longer than the strokes of the stems and thereby to enable a specified pressure to be asserted against contacts disposed within the vacuum interrupters.

According to another broad aspect of the invention a multi-phase vacuum contactor is provided which includes a housing; a carriage; an actuating mechanism having a reciprocating actuating arm, wherein the actuating mechanism is fixedly mounted to the housing and the actuating arm is connected to the carriage; and a plurality of vacuum interrupters, each having a reciprocating stem for the actuation thereof, wherein the interrupters are fixedly mounted to the housing and the stems are connected to the carriage such that the stroke of the actuating arm and the strokes of the stems are orientated in substantially parallel directions.

BRIEF DESCRIPTION OF DRAWINGS

The foregoing and other aspects of the invention will be better understood by reference to a detailed description of a preferred embodiment thereof and the accompanying drawings illustrating same. In the drawings.

DETAILED DESCRIPTION OF PREFERRED EMBODIMENTS

Figure 3:
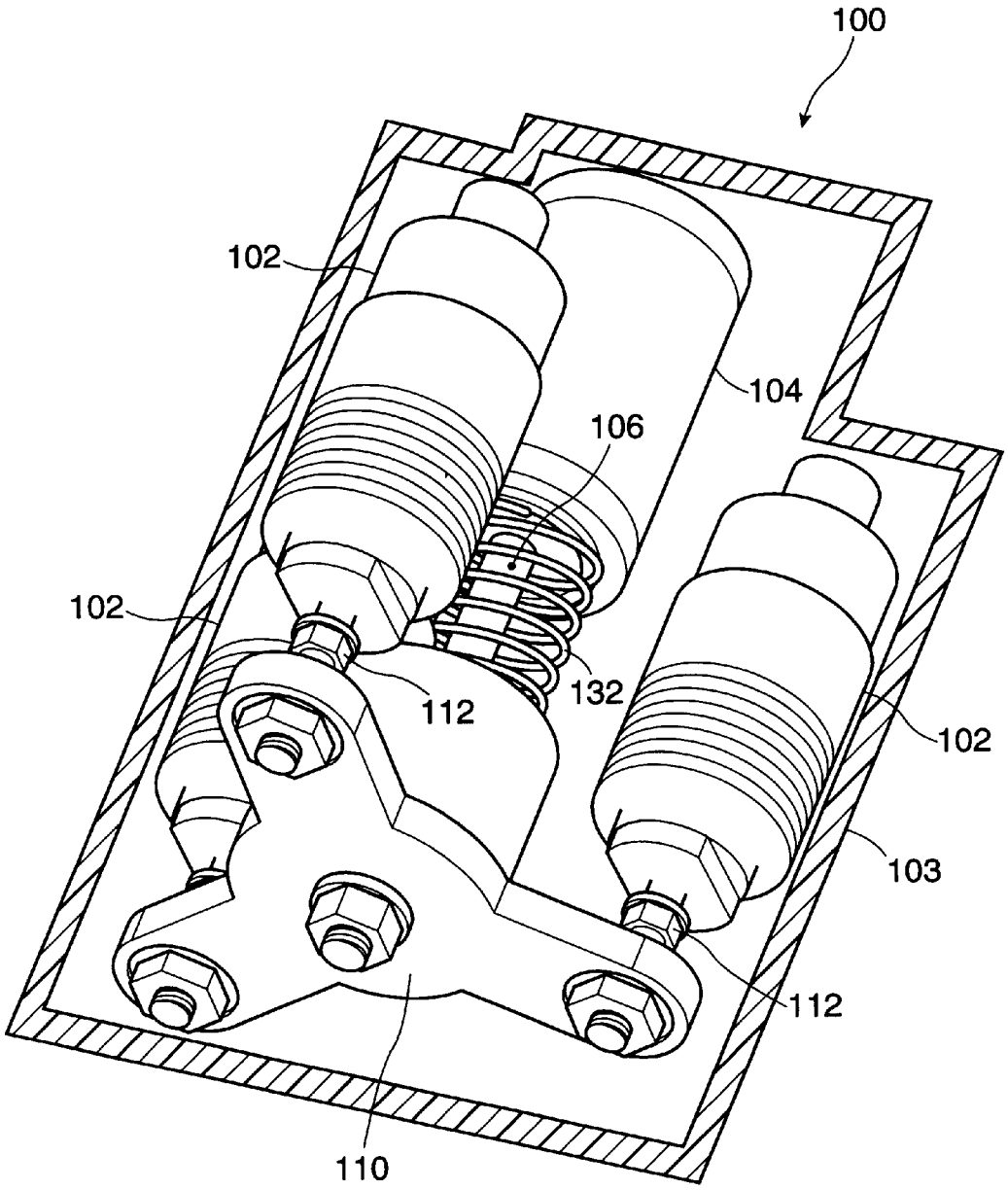
FIG. 3 is a perspective view of a three-phase vacuum contactor according to the preferred embodiment.

FIG. 3 is a perspective view of a three-phase contactor 100 in accordance with the preferred embodiment. Contactor 100 comprises three vacuum interrupters 102 which are circumferencially arranged around an electromagnetic actuating device 104. The actuator 104 is preferably equidistantly spaced from each of the vacuum interrupters 102 and the longitudinal axes of these elements 102 and 104 are preferably disposed in parallel to one another. The actuator 104 and vacuum interrupters 102 are preferably fixed at one end thereof (the upper end in the illustration) to a casing 103 (only partially shown in schematic form) which may be cylindrically, triangularly or rectangularly shaped, as desired.

Figure 2:
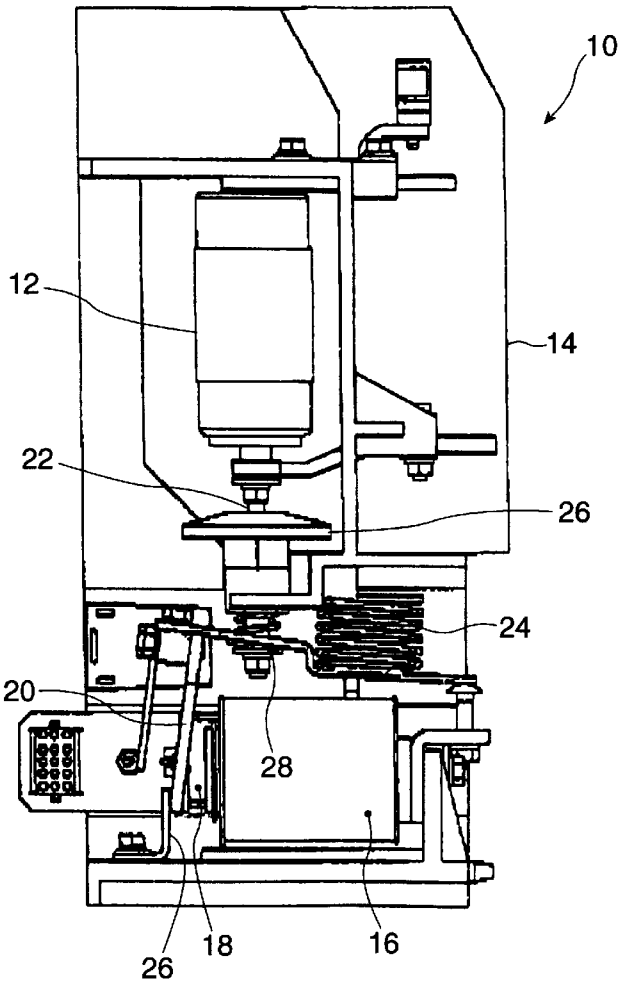
Fig. 2 Prior Art
FIG. 2 is a cross-sectional view of the contactor shown in FIG. 1.
Figure 1:
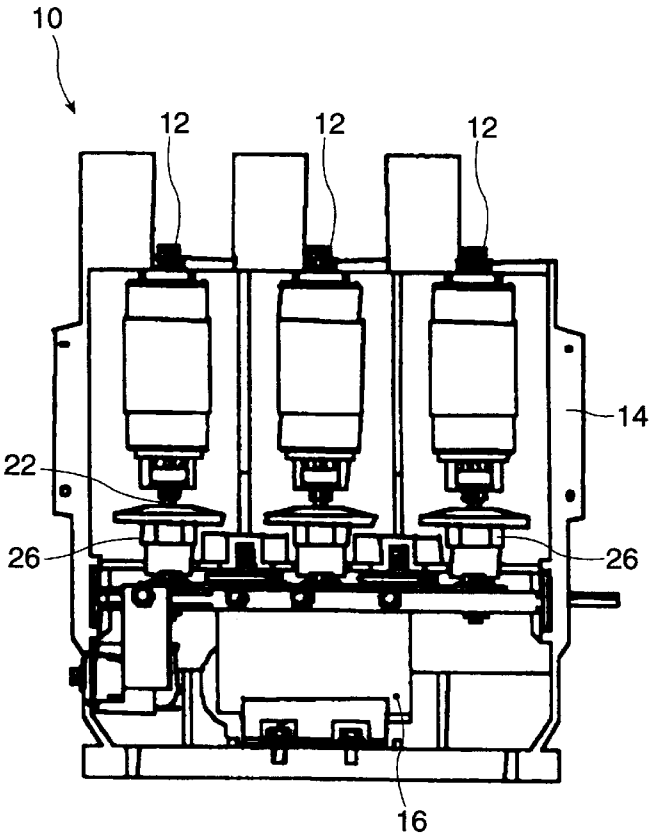
Fig. 1 Prior Art
FIG. 1 is a front view of a typical prior art three-phase vacuum contactor.

The actuator 104 comprises an armature 106 and each vacuum interrupter 102 comprises a moveable shaft or stem 112. The armature 104 and moveable shafts or stems 112 lie at the opposite end of the contactor 100 and are interconnected by a carriage 110. In this manner, the longitudinal axes of vacuum interrupters 102 are substantially parallel to a longitudinal axis of actuator 104 and the stroke of actuator 104 is substantially parallel to the strokes of the stems 112 of vacuum interrupters 102. This design presents a smaller space envelope as compared to the relative orientations of the vacuum interrupters and electromagnetic actuating device of the prior art contactor 10 shown in FIGS. 1 and 2.

Figure 4:
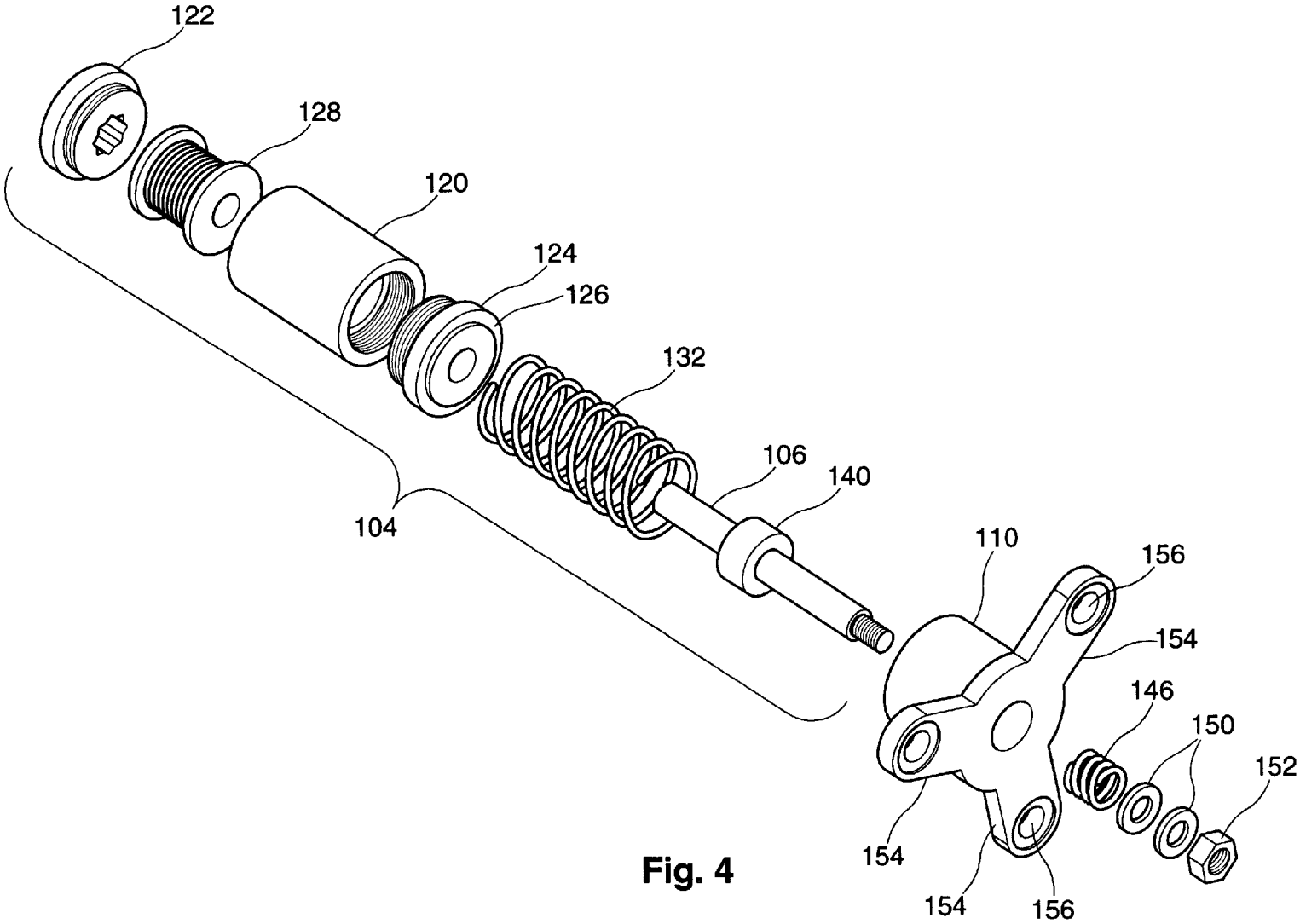
FIG. 4 is an isolated, exploded view of an actuating mechanism employed in the preferred vacuum contactor.
Figure 5:
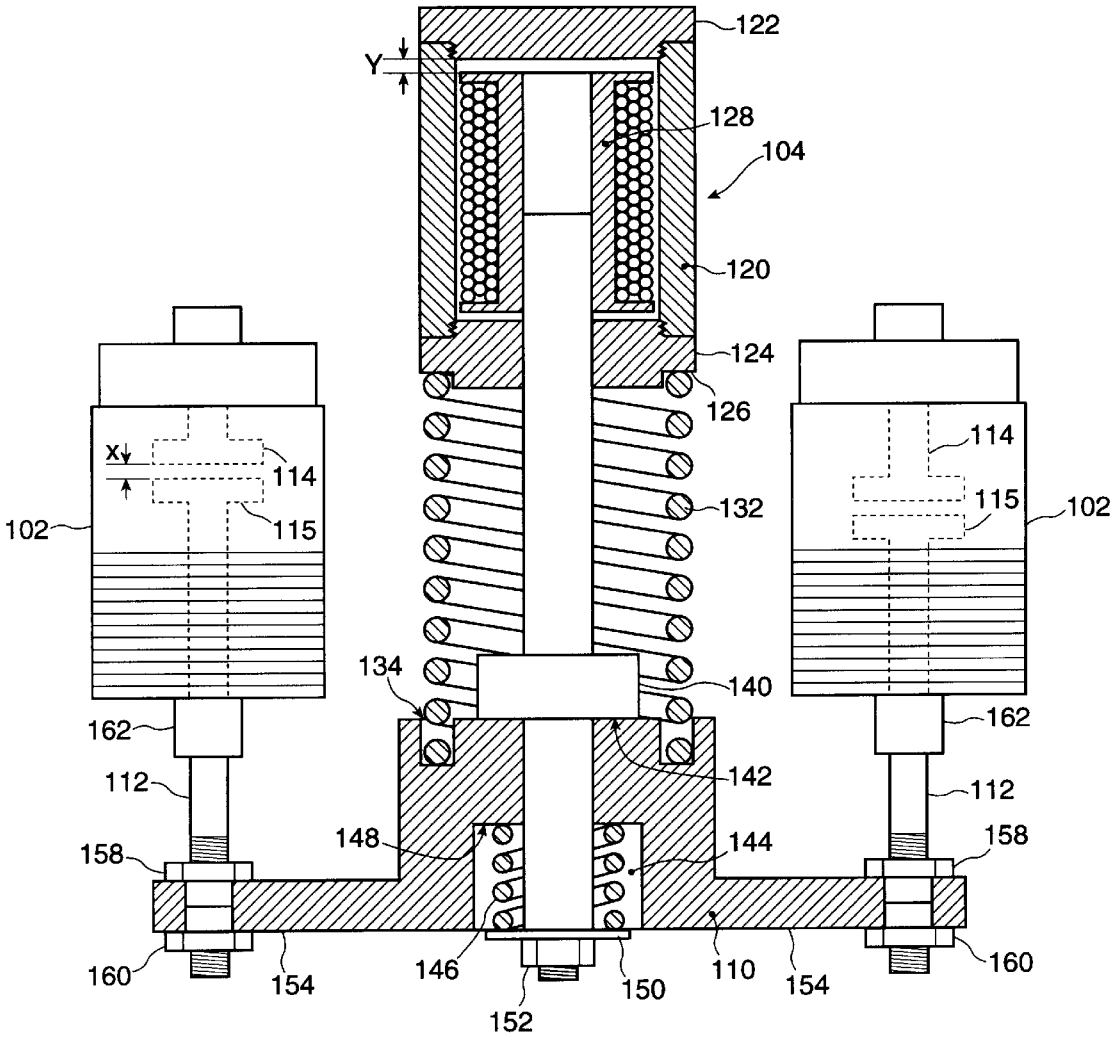
FIG. 5 is a partial front, partial cross-sectional view of the preferred vacuum contactor.

FIG. 4 shows the actuator 104 and carriage 110 in exploded view. FIG. 5 is a partial front, partial cross-sectional view of the contactor 100. Referring additionally to these drawings, it will be seen that the actuator 104 comprises a can or cylinder 120 which is threaded at its opposite ends. One end of cylinder 120 is fitted with an end cap 122 that is fixed to the contactor casing or housing. The other end of cylinder 120 is fitted with a bored cap 124 having flange 126. A bobbin 128 is mounted within cylinder 120. The bobbin 128 is bored to allow armature 106 to ride therethrough. The armature 106 is preferably constructed out of a ferromagnetic material and a coil of wire is wound around the bobbin 128 in order to induce a magnetic field and actuate the armature 106.

A biasing spring 132 is disposed between end cap 124 and the carriage 110. The biasing spring 132 is welded or otherwise fixed to the end cap 124 at flange 126 and an annular groove 134 is milled into the carriage 110 in order to accommodate the spring 132 while minimizing the length of the contactor.

The armature 106 features an integral, rigid, shoulder 140. This shoulder abuts against a bearing surface 142 of carriage 110. A cavity 144 exists at the opposite end of the carriage 110. Within this cavity an over-travel spring 146 is disposed about the armature 106. The spring 146 bears against an upper surface 148 of the cavity 144 and a washer 150 fitted over the armature 106. The armature 106 is threaded at this end and fitted with a lock nut 152. The washer 150 and lock nut 152 have a diameter smaller than that of cavity 144 and thus may enter it. The cavity 144 is also useful for keeping the length of contactor 100 to a minimum.

The carriage 110 features integral wings 154 for interconnecting the vacuum interrupters 102. Mounting holes 156 are formed in the wings for this purpose. More particularly, each shaft or stem 112 of vacuum interrupter 102 is threaded at its lower end and fitted with two oppositely rotating threaded collars 158 and 160 which lock the stem 112 to wings 154 while at the same time allowing the positional relationship between the vacuum interrupter and carriage 110 to be adjusted (see FIG. 5).

Insulators 162 may be fitted about stems 112, if desired. Also, a cylindrical shield or insulator (not shown) may be fitted over the actuator 104 to isolate it from stray electromagnetic interference.

In operation, when the actuator 104 is in an unenergized state the contactor 100 is in the open position, i.e., the contacts 114, 115 (shown schematically) of the vacuum interrupters 102 are spaced apart. This is accomplished by the biasing spring 132 which urges the carriage 110 away from the actuator 104 since the latter is fixed to the contactor casing at end cap 122. This action, in turn, maintains the contacts 114, 115 of vacuum interrupters 102 in the open position, provided of course that collars 158 and 160 have been appropriately set to space apart the vacuum interrupters 102 from the carriage 110.

When the actuator 104 is unenergized the biasing spring 132 will cause an air gap Y to be left between one end of the armature at 106 and end cap 122 (see FIG. 5). When the actuator 104 is energized the ferromagnetic armature 106 is induced to move and close this gap. Consequently, the washer 150 and lock nut 152 load the over-travel spring 146 which, in turn, bears on the carriage 110 to compress the biasing spring 132. The net result is that the carriage 110 is urged toward the fixed actuator 104 to thereby close the stems 112 and contacts 114, 115 of the vacuum interrupters 112. The over-travel spring 146 enables the actuator 104 to apply a pre-specified amount of pressure to the vacuum interrupter contacts 114, 115. For this reason, the spacing X between contacts 114, 115 when the contactor 100 is in the open position is less than the gap Y between the armature 106 and end cap 122 when the actuator 104 is unenergized.

The preferred embodiment allows the positional relationships of the various components of contactor 100 to be readily adjusted. Threaded cap 124 allows the spacing between the carriage 110 and actuator 104 to be adjusted in order to adjust the biasing force provided by spring 132. Lock nut 152 can also be used in a like manner to adjust the length of and hence the load provided by the over-travel spring 146 to the contacts 114, 115 of the vacuum interrupters. Similarly, counteracting collars 158, 160 can be used to adjust the spacing of the vacuum interrupters 112 from the carriage 110.

In alternative embodiments the over-travel spring 146 may be replaced by three separate springs disposed about the stems 112 of each vacuum interrupter 102.

This will allow for greater flexibility in adjusting the pressure applied to the contacts 114, 115 of the vacuum interrupters. In addition, the biasing spring 132 and the over-travel spring 146 may be replaced by other types of resilient members such as wave springs or belleville springs (alternatively referred to as conical washers). Similarly, those skilled in the art will understand that numerous modifications and variations may be made to the embodiments disclosed herein without departing from the spirit and scope of the invention.

What is claimed is:

1. A multi-phase vacuum contactor, comprising:

a housing;

a carriage;

an actuating mechanism having a reciprocating actuating arm, wherein the actuating mechanism is fixedly mounted to the housing and the actuating arm is connected to the carriage;

a plurality of vacuum interrupters, each having a reciprocating stem for the actuation thereof, wherein the interrupters are fixedly mounted to the housing and the stems are connected to the carriage such that the stroke of said actuating arm and the strokes of the stems are orientated in substantially parallel directions; and a resilient member disposed between the body of the actuating mechanism and the carriage for biasing the vacuum interrupters in the open position.

2. The contactor according to claim 1, wherein the vacuum interrupters are circumferentially arranged around the actuating mechanism.

3. The contactor according to claim 2, wherein the stem of each vacuum interrupter reciprocates between a first position wherein the vacuum interrupter is open and a second position wherein the vacuum interrupter is closed.

4. The contactor according to claim 3, including a second resilient member disposed between one of (i) the actuating arm and the carriage and (ii) the carriage and each vacuum interrupter, for enabling the stroke of the actuating arm to be longer than the strokes of the stems to thereby enable a specified pressure to be asserted against contacts within the vacuum interrupters.

5. A multi-phase vacuum contactor, comprising:

a housing;

a carriage;

an electromagnetic actuating mechanism fixed to the housing and having a reciprocating armature connected to the carriage;

a plurality of vacuum interrupters each having a reciprocating stem for the actuation thereof, wherein the vacuum interrupters are fixed to the housing and circumferencially arranged about the electromagnetic actuating mechanism such that longitudinal axes of the vacuum interrupters are substantially parallel to a longitudinal axis of the electromagnetic actuating mechanism, and wherein the stem of each vacuum interrupter is connected to the carriage; and a resilient member disposed between the actuating mechanism and the carriage for biasing the vacuum interrupters in the open position.

6. The contactor according to claim 5, wherein the stem of each vacuum interrupter reciprocates between a first position wherein the vacuum interrupter is open and a second position wherein the vacuum interrupter is closed.

7. The contactor according to claim 6, including a second resilient member disposed between one of (i) the armature and the carriage and (ii) the carriage and each vacuum interrupter, for enabling the stroke of the armature to be longer than the strokes of the stems and thereby to enable a specified pressure to be asserted against contacts within the vacuum interrupters.

* * * * *